United States Patent [19]

Jansen et al.

[11] Patent Number: 4,859,553

[45] Date of Patent: Aug. 22, 1989

[54] IMAGING MEMBERS WITH PLASMA DEPOSITED SILICON OXIDES

[75] Inventors: Frank Jansen; Joseph Mort, both of Webster, N.Y.

[73] Assignee: Xerox Corporation, Stamford, Conn.

[21] Appl. No.: 45,646

[22] Filed: May 4, 1987

[51] Int. Cl.[4] ..... G03G 5/10

[52] U.S. Cl. ..... 430/58; 430/63; 430/84; 430/95

[58] Field of Search ..... 430/57, 58, 62, 63, 430/66, 84, 95

[56] References Cited

U.S. PATENT DOCUMENTS 4,557,987 12/1985 Shirai et al. ..... 430/58
4,613,556 9/1986 Mort et al. ..... 430/60
4,663,258 5/1987 Pai et al. ..... 430/57
4,698,288 10/1987 Mort ..... 430/69

OTHER PUBLICATIONS

"Thin Film Preparation by Plasma and Low Pressure CVD in a Horizontal Reactor", C. E. Morosana & V. Soltuz, Jan. 19, 1981, Vacuum, vol. 31, No. 7, pp. 309 to 313.

*Primary Examiner*—John L. Goodrow
*Attorney, Agent, or Firm*—E. O. Palazzo

[57] ABSTRACT

Disclosed is an electrographic imaging member comprised of a supporting substrate; and in contact therewith components comprised of regions of a photogenerating substance dispersed in a charge transporting material comprised of plasma deposited silicon oxide with at least 50 atomic percent of oxygen.

31 Claims, 1 Drawing Sheet

IMAGING MEMBERS WITH PLASMA DEPOSITED SILICON OXIDES

BACKGROUND OF THE INVENTION

This invention is generally directed to imaging members for electrographic applications, and more specifically, the present invention is directed to photoconductive imaging members comprised of silicon and silicon oxide. Therefore, in one embodiment of the present invention, there is provided a photoresponsive imaging member comprised of a supporting substrate and in contact therewith a photogenerating and charge transport layer comprised of islands of hydrogenated amorphous silicon, or crystalline silicon present in a silicon oxide matrix containing at least 50 atomic percent of oxygen. More specifically, in one embodiment of the present invention there is provided an imaging member comprised of a supporting substrate in contact therewith, and adhering thereto a layer comprising a photogenerating substance, such as hydrogenated amorphous silicon, or crystalline silicon dispersed in charge transporting molecules, preferably comprised of silicon oxides formulated by plasma deposition, and containing at least 50 atomic percent of oxygen. The aforementioned imaging members can be incorporated into electrophotographic, and in particular xerographic imaging and printing systems wherein, for example, the formed latent electrostatic patterns are developed into images of high quality and excellent resolution. Moreover, the imaging members of the present invention possess high charge acceptance values corresponding to electric fields in excess of 50 volts per micron (50 volts/$\mu$m); and further these members can be of a very desirable thickness of from, for example, about 100 microns or less. Also, the imaging members of the present invention have desirable low dark decay and high cyclic stability properties enabling them to be particularly useful in xerographic imaging processes. In these processes, latent electrostatic images are formed on the imaging members illustrated herein, followed by development, transfer and fixing. Additionally, the photoresponsive imaging members of the present invention, when incorporated into xerographic imaging and printing systems, are insensitive to (1) humidity, of from, for example, 20 to 80 percent, and (2) corona ions permitting the formation of acceptable images of high resolution for an extended number of imaging cycles. Furthermore, the photoresponsive imaging members of the present invention which can be charged and photodischarged for negative, or positive polarities possess superior mechanical wear characteristics.

Electrostatographic imaging, particularly xerographic imaging processes, are well known, and are extensively described in the prior art. In these processes a photoconductor material is selected for forming latent electrostatic images thereon. The photoconductor is generally comprised of a conductive substrate containing on its surface a layer of photoconductive material; and in many instances, a thin barrier layer is situated therebetween to prevent charge injection from the substrate which injection could adversely effect the quality of the resulting image. Examples of known useful photoconductive materials include amorphous selenium, alloys of selenium such as selenium-tellurium, selenium-arsenic, and the like. Additionally, there can be selected as photoresponsive imaging members various organic photoconductive materials including, for example, complexes of trinitrofluorenone and polyvinylcarbazole. There are also disclosed layered organic photoresponsive devices with aryl amine hole transporting molecules, and photogenerating layers, reference U.S. Pat. No. 4,265,990, the disclosure of which is totally incorporated herein by reference.

Also known are amorphous silicon photoconductors, reference for example U.S. Pat. No. 4,265,991. There is disclosed in the '991 patent an electrophotographic photosensitive member comprised of a substrate, and a photoconductive overlayer of amorphous silicon containing 10 to 40 atomic percent of hydrogen with a thickness of 5 to 80 microns. Additionally, this patent describes several processes for preparing amorphous silicon members. In one process embodiment, there is prepared an electrophotographic photosensitive member by heating the member present in a chamber to a temperature of 50° C. to 350° C., thereafter introducing a gas with silicon and hydrogen atoms, providing an electrical discharge in the chamber by electric energy to ionize the gas, followed by depositing amorphous silicon on an electrophotographic substrate at a rate of 0.5 to 100 Angstroms per second by utilizing an electric discharge thereby resulting in an amorphous silicon photoconductive layer of a predetermined thickness. Although the amorphous silicon device described in this patent is photosensitive, after a minimum number of imaging cycles, less than about 100 for example, unacceptable low quality images of poor resolution with many deletions may result. With further cycling, that is subsequent to 100 imaging cycles and after 1,000 imaging cycles, the image quality may continue to deteriorate, often until images are completely deleted.

Further, there are disclosed in the prior art amorphous silicon photoreceptor imaging members containing, for example, stoichiometric silicon nitride overcoatings; however, these members in some instances generate prints of low resolution as a result of the electric field induced lateral conductivity in the photogenerator layer. Additionally, with the aforementioned silicon nitride overcoatings, the resolution loss can in many instances be extreme thereby preventing, for example, any image formation whatsoever.

Other representative prior art disclosing amorphous silicon imaging members, including those with overcoatings, are U.S. Pat. Nos. 4,460,669; 4,465,750; 4,394,426; 4,394,425; 4,409,308; 4,414,319; 4,443,529; 4,452,874; 4,452,875; 4,483,911; 4,359,512; 4,403,026; 4,416,962; 4,423,133; 4,460,670; 4,461,820; 4,484,809; and 4,490,453. Additionally, U.S. patents that may be of background interest with respect to hydrogenated amorphous silicon photoreceptor members include, for example Nos. 4,377,628; 4,420,546; 4,471,042; 4,477,549; 4,486,521; and 4,490,454.

Further, additional representative prior art patents that disclose amorphous silicon imaging members include, for example, 4,357,179 directed to methods for preparing imaging members containing high density amorphous silicon or germanium; 4,237,501 which discloses a method for preparing hydrogenated amorphous silicon wherein ammonia is introduced into a reaction chamber 4,359,514; 4,404,076; 4,397,933; 4,423,133; 4,461,819, 4,237,151; 4,356,246; 4,361,638; 4,365,013; 3,160,521; 3,160,522; 3,496,037; 4,394,426; and 3,892,650. Of specific interest are the amorphous silicon photoreceptors illustrated in U.S. Pat. No. 4,510,224, which discloses an electrophotographic photoreceptor comprising a hydrogenated amorphous silicon carbide transport layer 2 formed below a photoconductive layer 3, reference FIG. 5; 4,518,670 directed to an electrophotographic member comprising a transport layer 2 with at least one atomic percent nitrogen present therein, see FIGS. 1 to 4; and 4,495,262 describing an electrophotograpic photosensitive member comprising two amorphous hydrogenated silicon carbide layers 2 and 4, one on each side of the photoconductive layer 3, reference FIGS. 1 and 2. Additionally, processes for depositing large area defect free films of amorphous silicon by the glow discharge of silane gases are described by Chittick et al., the Journal of the Electrochemical Society, Volume 116, Page 77, (1969). Further, the fabrication and optimization of substrate temperatures during amorphous silicon fabrication is illustrated by Walter Spear, the Fifth International Conference on Amorphous and Liquid Semiconductors presented at Garmisch Partenkirchen, West Germany in 1963. Other silicon fabrication processes are described in the Journal of Non-Crystalline Solids, Volumes 8 to 10, Page 727, (1972), and the Journal of Non-Crystalline Solids, Volume 13, Page 55 (1973).

In addition, other prior art of interest includes U.S. Pat. No. 4,557,987, which discloses forming a film by the reaction of a silane and nitrous oxide, reference column 7; and an article by C. E. Morosanu, entitled Thin Film Preparation By Plasma and Low Pressure CVD In A Horizontal Reactor, wherein there is illustrated the formation of silicon, silicon oxide, and sliicon nitride films by chemical vapor deposition. Also, other references of background interest relating to hydrogenated amorphous silicon imaging members include U.S. Pat. Nos. 4,217,374; 4,237,150; 4,237,151; 4,565,731; 4,613,556; and 4,615,905.

There are also illustrated in other patents photoconductive imaging members comprised of amorphous silicon. Accordingly, for example, there is illustrated in U.S. Pat. No. 4,634,647 entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorus. Furthermore, there is described in U.S. Pat. No. 4,544,616 entitlted Electrophotographic Devices Containing Overcoated Amorphous Silicon Compositions, the disclosure of which is totally incorporated herein by reference, imaging members comprised of a supporting substrate, an amorphous silicon layer, a trapping layer comprised of doped amorphous silicon, and a top overcoating layer of stoichiometric silicon nitrides. More specifically, there is disclosed in this patent an imaging member comprised of a supporting substrate; a carrier transport layer comprised of uncompensated or undoped amorphous silicon; or amorphous silicon slightly doped with p or n type dopants such as boron or phosphorus; a thin trapping layer comprised of amorphous silicon which is heavily doped with p or n type dopants such as boron or phosphorus; and a top overcoating layer of silicon nitride of specific compositions, silicon carbide, or amorphous carbon. However, one disadvantage with this imaging member is that the trapping layer introduces a dark decay component which reduces the charge acceptance for the imaging member.

Additionally, described in copending application U.S. Pat. No. 4,613,556, entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide containing at least 50 atomic percent of oxygen. Moreover, there are disclosed in copending application U.S. Pat. No. 4,737,429, relating to amorphous silicon imaging members, the disclosure of which is totally incorporated herein by reference, photoresponsive imaging members comprised of a supporting substrate; a photoconductive layer of hydrogenated amorphous silicon in contact therewith; and a charge transport layer comprised of components selected from the group consisting of hydrogenated or halogenated silicon nitrides, boron nitrides, aluminum nitrides, phosphorus nitrides, gallium nitrides, gallium phosphides, boron phosphides, aluminum phosphides, boron oxide, aluminum oxide, gallium oxide, and plasma deposited organosilanes. Furthermore, the photoresponsive imaging members of the aforementioned copending application can contain a top protective overcoating layer; and the charge transport layer can be situated between the photoconductive layer of hydrogenated amorphous silicon, and the supporting substrate; or alternatively, is in contact with the photoconductive layer situated between the supporting substrate, and the charge transport layer.

Although the above described amorphous silicon photoresponsive members, particularly those disclosed in the copending applications and Xerox patents are suitable for their intended purposes, there continues to be a need for improved members comprised of silicon and silicon alloys. Additionally, there is a need for silicon based imaging members that possess desirable high charge acceptance values, low charge loss characteristics in the dark, improved adhesion characteristics, excellent transport of electrical charges, and improved cyclic stability. Furthermore, there continues to be a need for improved silicon based imaging members, with specific charge transport layers. Also, there is a need for silicon based imaging members with transport layers of silicon oxide containing spatially distributed photoconductive regions of silicon or hydrogenated amorphous silicon or other silicon alloys, thereby enabling members with superior mechanical wear characteristics. Abrasive wear of members with the aforementioned spatially distributed photoconductive regions do not evidence an abrupt failure mode due to the wear of the discrete photoconductive layer, but rather retain their photoconductive properties during the imaging process. Further, there is a need for imaging members with the aforementioned charge transport layers, and where there is introduced therein, by the compositional control of constitutent materials, electronic defect states of sufficient density enabling transport to be accomplished by hopping between the resulting localized states. These states are energetically positioned in the band gap of the charge transport component to permit the efficient injection of carriers from the silicon photogenerating regions. Furthermore, there is a need for silicon based imaging members with the properties of low surface potential decay rates in the dark, and photosensitivity in the visible and the near visible wavelength range. Also, there is a need for imaging members with improved charge transport characteristics thereby permitting the residual voltage after optical exposure to be of a relatively small value, that is from about 0 volts to about 10 volts, which voltage remains substantially constant upon repeated cycling of the imaging member.

SUMMARY OF THE INVENTION

It is therefore an object of the present invention to provide photoresponsive imaging members with the above noted advantages.

In another object of the present invention there are provided photoresponsive imaging members comprised of silicon and silicon oxide, which members possess high charge acceptance values, low dark decay characteristics and superior cyclic stability.

In yet another object of the present invention there are provided photoresponsive imaging members comprising of silicon oxide and containing therein regions of amorphous hydrogenated silicon, amorphous halogenated silicon, or crystalline silicon.

In another object of the present invention there are provided photoresponsive imaging members comprised of silicon oxide containing therein regions of amorphous hydrogenated silicon, amorphous halogenated silicon, or crystalline silicon overcoated with protective layers such as silicon nitride, silicon carbide, amorphous carbon, or compositions similar to those selected for the charge transport material.

Additionally, in a more specific object of the present invention there is provided a photoresponsive imaging member comprised of a supporting substrate in contact therewith, and adhered thereto a layer comprised of a photogenerating substance dispersed in a charge transport material comprised of plasma deposited silicon oxides.

Furthermore, in another object of the present invention there are provided imaging and printing methods with the silicon based imaging members illustrated herein.

These and other objects of the present invention are accomplished by the provision of a silicon based photoresponsive imaging member. More specifically, in accordance with the present invention there are provided photoresponsive imaging members comprised of amorphous silicon oxide, a charge transport material that possesses band gap states at a sufficiently high density to enable charge transport by their wave function overlap; and in contact therewith and contained therein photoconductive regions of amorphous hydrogenated silicon, amorphous halogenated silicon, mixtures thereof; or crystalline silicon, and an optional top overcoating layer. Wave function overlap refers to a concept well known in solid state physics which associated a wave function with the position of a particle such as a charge carrier. Thus, the wave function is related to the statistical probability that a charge carrier can be found in a certain position. Accordingly, an overlapping wave function of two defect sites indicates that a charge carrier can travel between the two positions.

In one specific embodiment of the present invention there is provided a photoresponsive imaging member comprised of a supporting substrate; in and adhering contact therewith, a charge transport photogenerating layer comprised of plasma deposited silicon oxide with at least 50 atomic percent of oxygen having dispersed therein regions of amorphous hydrogenated silicon or halogenated amorphous silicon with, for example, from about 10 to about 40 atomic percent of hydrogen or halogen, respectively; or regions of crystalline silicon, and thereover an optional top protective overcoating layer selected, for example, from the group consisting of silicon nitrides, silicon carbides and carbon. The component layer in contact with the supporting substrate functions simultaneously as a charge transporting medium, and as a photogenerating material. Therefore, in one aspect the present invention is directed to an electrophotographic imaging member comprised of a supporting substrate; and in contact therewith, a photogenerating charge transport layer comprised of a photogenerating substance dispersed in a charge transporting material comprised of plasma deposited silicon oxide with at least 50 atomic percent of oxygen.

The photoconductive imaging members of the present invention can be incorporated into various imaging apparatuses wherein, for example, latent electrostatic images are formed followed by development, subsequently transferring the developed image to a suitable substrate; and optionally permanently affixing the image thereto. Moreover, the photoconductive imaging members of the present invention can be selected for use in xerographic printing processes, that is for example, when the member includes therein a component which is sensitive to the infrared region of the spectrum. Also, the photoresponsive imaging members of the present invention can be incorporated into imaging apparatuses wherein there is selected for rendering the images visible a liquid devleoped process. Additionally, the photoresponsive imaging members of the present invention, when incorporated into xerographic imaging processes, possess high charge acceptances of, for example, about 40 volts per micron or greater for both positive and negative polarities of charge; have very low dark decay characteristics of, for example, 10 volts per second per micron at electrical field strengths of 40 volts per micron; and can be fabricated with the aforementioned desirable properties in a thickness of about 100 microns or less. Also, the photoconductive members of the present invention enable the generation of images with high resolution for an extended number of imaging cycles exceeding, in most instances, 500,000 cycles. Furthermore, the imaging members of the present invention are very insensitive to mecanical wear since these members do not contain one very thin photoconductive layer but rather are comprised of spatially distributed photoconductive regions, which enables bulk photogeneration of carriers to occur thus ensuring neutralization of any bulk trapped charge and permitting superior cyclic stability. Furthermore, with the imaging members of the present invention there is enabled the generation of images with substantially no white spots in black backgrounds. In addition, the photoresponsive members of the present invention can be incorporated into xerographic printing and imaging apparatuses, inclusive of those with solid state lasers or electroluminescent length sources as these members can be rendered sufficiently sensitive to wavelengths of up to 8,2000 Angstroms. Also, the photoresponsive imaging members of the present invention, when in use, are substantially insensitive to humidity of from about 20 to about 80 percent; and corona ions generated from corona charging devices enabling these members to generate acceptable images of high resolution for an extended number of imaging cycles.

BRIEF DESCRIPTION OF THE DRAWINGS

For a better understanding of the present invention and further features thereof, reference is made to the following description of the preferred embodiments wherein.

Figure 1:
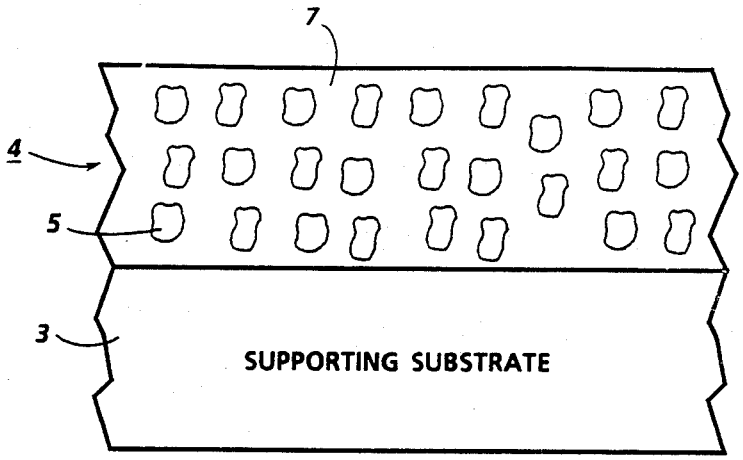
FIG. 1 is a partially schematic cross-sectional view of a photoresponsive imaging member of the present invention.

Illustrated in FIG. 1 is a photoresponsive imaging member of the present invention comprised of a supporting substrate 3, and in contact therewith a photogenerating transport layer 4 comprised of regions of photogenerating substances 5 of, for example, hydrogenated or halogenated amorphous silicon with from about 10 to about 40 atomic percent of hydrogen or halogen, respectively, which photogenerating substances are present in a matrix of hole transporting molecules 7 comprised of silicon oxides with at least 50 atomic percent of oxygen as illustrated in U.S. Pat. No. 4,613,556, the disclosure of which is totally incorporated herein by reference. Generally, the thickness of the photogenerating charge transport layer is from about 5 to about 100 mirons, and preferably from about 5 to about 25 mirons; and the average diameter of the photogenerating substances is from about 0.05 to 5 mirons, and preferably from about 1 to about 2 microns. Also, the concentration of the photogenerating pigment particles 5 can vary depending on a number of factors, including the exact components present. Generally, however, this concentration is from about 2 to about 50 percent by volume with the preferred concentration being from about 5 to about 10 percent by volume.

Figure 2:
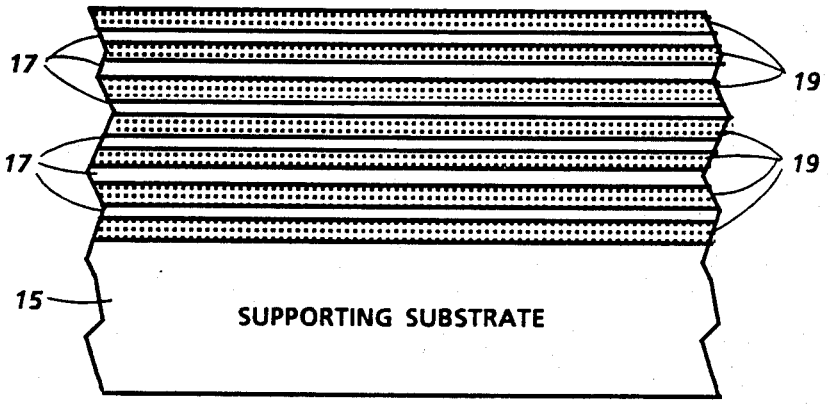
FIG. 2 is a partially schematic cross-sectional view of a second photoresponsive imaging member of the present invention.

Illustrated in FIG. 2 is another photoresponsive imaging member of the present invention comprised of a supporting substrate 15, and in contact therewith a photogenerating charge transport layer comprised of photogenerating pigment regions 17 containing hydrogenated or halogenated amorphous silicon with from about 10 to about 40 atomic percent of hydrogen or halogen, respectively; or crystalline silicon, and hole charge transport regions 19 comprised of amorphous silicon oxide with at least 50 atomic percent of oxygen. Generally, the photogenerating regions 17 are of a thickness of from about 0.01 micron to about 0.3 micron, and preferably are of a thickness of about 0.1 micron, while the thickness of the charge transport region is from about 0.5 micron to about 1 micron, and preferably 1 micron. The total thickness of the photogenerating charge transport layer is dependent on a number of factors including the exact components present in the imaging member. Generally, however, this layer is of a thickness of from about 5 to about 100 microns.

In another embodiment of the present invention, the imaging members may contain overcoatings thereover. Thus, with respect to FIG. 1, for example, there can be included in contact with the photogenerating charge transporting regions an optically transparent partially conductive top overcoating comprised of, for example, silicon nitrides, silicon carbides, silicon oxynitrides, and crystalline or amorphous carbon, which layer is generally of a thickness of from about 0.1 to about 1 micron, and preferably of a thickness of about 0.5 micron.

It is believed, although it is not desired to be limited by theory especially with regard to the member of FIG. 1, that a charge transport channel, or a manifold of charge transport channels in the charge transport material can be accessed by carriers generated in the photoconductive silicon. The charge transport manifold most likely contains a high density of localized states in the forbidden gap of the charge transport component. This high density permits the charge to transfer or hop from site to site thus rendering what is commonly perceived as an insulator to be conductive for injected carriers. The ambipolar nature of the devices of the present invention indicates that the energy of the transport states in the transport layer is such that they are situated between the conduction and the valence band of the photoconductive silicon when brought into contact with the charge transport components. The selection of crystalline silicon without hydrogen is useful as the band gap of this material is less than that of the hydrogenated amorphous silicon thus permitting photoresponse to longer wavelengths of, for example, 8,2000 Angstroms.

The supporting sustrates for each of the imaging members of the present invention, particularly those illustrated in the Figures, may be opaque or substantially transparent, thus this substrate can be comprised of numerous substances providing the objectives of the present invention are achieved. Specific examples of substrates are insulating materials such as inorganic or organic polymeric compositions; a layer of an organic of inorganic material having a semiconductive surface layer thereon, such as indium tin oxide; or as described in copending application U.S. Pat. No. 4,698,288 entitled Electrophotographic Imaging Members, the disclosure of which is totally incorporated herein by reference, an amorphous silicon layer heavily doped with boron or phosphorus thereby permitting this layer to function as a ground plane; or an electrically conductive material such as, for example, aluminum, chormium, nickel, brass, stainless steel, and the like. The substrate may be flexible or rigid and can have many different configurations such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an anticurl layer such as, for example, polycarbonate materials commerically available as Makrolon. The substrates are preferably comprised of aluminum, stainless steel, nickel or glass with an electrically conductive ground plane. The thickness of the substrate layer depends on many factors including economical considerations, and the mechanical properties desired, for example. Accordingly thus, this layer can be of a thickness of from about 0.004 inch (100 microns) to about 0.2 inch (5,000 microns), and preferably is of a thickness of from about 0.05 inch (1,270 microns) to about 0.5 inch (3,810 microns).

Illustrative examples of materials selected for the photogenerating component regions are crystalline silicons, amorphous silicons, especially hydrogenated amorphous silicon, with from about 10 to about 40 atomic percent of hydrogen as more specifically described in the copending applications and patents referred to hereinbefore. Also, particularly useful when extended spectral response is desired, that is about 8,200 Angstroms, are photogenerating materials comprised of microcrystalline silicon, polycrystalline silicon and crystalline silicon.

Illustrative examples of charge transport materials in addition to the plasma deposited silicon oxide that may be selected for the imaging members for the present invention include plasma deposited nitrides such as silicon nitride, boron nitride, aluminum nitride, phosphorus nitride, and gallium nitride, reference copending application U.S. Pat. No. 4,737,429 the disclosure of which is total incorporated hereinby reference.

The spatial distribution of the photoconductive or photogeneraitng component in the charge transporting matrix might be obtained by a wide variety of fabrication and deposition methods. Thus, for example, there can be treated at high temperatures premixed powders of crystalline silicon and amorphous silicon oxide to cause fusing or sintering of these particles such that a film of uniform thickness and desired characteristics is formed. It is also possible to form the imaging member by thin film vacuum deposition techniques, such as chemical vapor deposition or plasma enhanced chemical vapor deposition, by periodically changing the composition of the feed gases impingent upon areas of the substrate.

Thus, more specifically, imaging members of the present invention can be prepared by several different methods. One method comprises the sintering of pulverized materials at elevated temperatures. Specifically, powders of crystalline silicon with an average diameter size of 2.7 microns may be heated for one hour at 830° C. in an inert atmosphere with pulverized silica of a 1.8 micron average diameter size; and thereafter distributed on a supporting substrate. These powders can be premixed in the desired ratios of, for example, a 1:30 silicon to silicon oxide ratio. Films of the material are obtained by uniformly distributing the premixed powders on refractory metal substrates such as staineless steels. Imaging members of the present invention can be prepared by inducing the phase separation of immiscible materials at high temperatures. Thus, for example, metastable homogeneous alloy films may be prepared at some relatively low temperature such as 25° C., including for example a silicon-oxide system which forms silicon oxide with silicon islands at temperatures exceeding 1100° C. for silicon-rich starting compositions. Thus, islands of crystalline silicon are contained in the optically transparent polycrystalline silicon oxide matrix after annealing at the aforementioned high temperatures. Yet another fabrication process has been described by DiMaria et al. in the Journal of Applied Physics, Volume 54, Issue 10, October 1983, the disclosure of which is totally incorporated herein by reference, where non-stoichiometric silicon dioxide films are described and prepared by the chemical vapor deposition of silane and nitrous oxide gas mixtures. The silicon-rich silicon dioxide layers that are formed are comprised of amorphous silicon islands or small crystallites embedded in a silicon dioxide matrix thus forming a two phase material. Furthermore, another fabrication process is conducted in accordance with the deposition processes as described in U.S. Pat. Nos. 4,466,380 and 4,513,022, the disclosures of which are totally incorporated herein by reference. More specifically thus, for example, the imaging members of the present invention can be prepared by simultaneously introducing into a reaction chamber a silane gas often in combination with other gases for the purpose of doping or alloying, periodically interrupted by the introduction of more silane gas. In one specific embodiment, the process of preparation involves providing a receptacle containing therein a first substrate electrode means, and a second counterelectrode means providing a cylindrical surface of the first electrode means, heating the cylindrical surface with heating elements contained in the first electrode means while causing the first electrode means to axially rotate, introducing into the reaction vessel a source of silicon containing gas often in combination with other diluting, doping or alloying gases at a right angle with respect to the cylindrical member, applying an rf voltage on the second electrode with the first electrode grounded whereby the silane gas is decomposed resulting in the deposition of hydrogenated amorphous silicon or doped hydrogenated amorphous silicon on the cylindrical member. Thereafter, there are introduced into the reaction chamber other appropriate gases such as ammonia or nitrogen mixtures. Other charge transport layers can be obtained by utilizing other mixtures as illustrated hereinbefore including aluminum alkyl and nitrogen or ammonia mixtures. Also, in one embodiment of the present invention the total flow rate of the gases is maintained at between 50 and 400 sccm, the gas mixture pressure is held at a constant 100 to 1,000 milliTorr, the radio frequency electrical power density is between 0.01 and 1 watts/cm$^2$ of electrode area, and the substrate temperature during the deposition process can be between room temperature and 400° C..

Specifically, therefore, amorphous silicon photogeneration regions can be deposited by the glow discharge decomposition of a silane gas alone, or decomposition in the presence of small amounts of dopant gases such as diborane and/or phosphine. The range of useful flow rates, radio frequency power levels and reactor pressures are approximately the same as that described in the copending applications referred to herein.

Process and apparatus useful for preparing the photoresponsive devices of the present invention are specifically disclosed in U.S. Pat. No. 4,466,380, the disclosure of which has been totally incorporated herein by reference. Specifically, the apparatus disclosed in this patent is comprised of a rotating cylindrical first electrode means 3 secured on an electrically insulating shaft; radiant heating element 2 situated within the first electrode means 3; connecting wires 6; a hollow shaft rotatable vacuum feedthrough 4; a heating source 8; a hollow drum substrate 5 containing therein the first electrode means 3, the drum substrate being secured by end flanges which are part of the first electrode means 3; a second hollow counterelectrode means 7 with flanges thereon 9, and slits or vertical slots 10 and 11; receptacle or chamber means 15 containing as an integral part thereof receptacles 17 and 18 for flanges 9 for mounting the module in the chamber 15; a capacitive manometric vacuum sensor 23; a gauge 25; a vacuum pump 27 with a throttle valve 29; mass flow controls 31; a gauge and set point box 33; gas pressure vessels 34, 35, and 36, for example, pressure vessel 34 containing silane gas, and 35 nitrous oxide; a radio frequent electrical power source means 37 for the first electrode means 3 and a second counterelectrode means 7. The chamber 15 has an entrance means 19 for the source gas material and an exhaust means 21 for the unused gas source material. In operation, the chamber 15 is evacuated by vacuum pump 27 to appropriate low pressures. Subsequently, a silane gas, often in combination with other gases originating from vessels 34, 35 and 36, are simultaneously introduced into the chamber 15 through entrance means 19, the flow of the gases being controlled by the mass flow controller 31. These gases are introduced into the entrance 19 in a crossflow direction, that is the gas flows in the direction perpendicular to the axis of the cylindrical substrate 15 contained on the first electrode means 3. Prior to the introduction of the gases, the first electrode means is caused to rotate by a motor and power is supplied to the radiant heating elements 2 by heating source 8, while electrical power is applied to the first electrode means, and the second counterelectrode means by a power source 37. Generally, sufficient power is applied from the heating source 8 that will maintain the drum 5 at a temperature ranging from about room temperature to about 350° C.. The pressure in the chamber 15 is automatically regulated so as to correspond to the setting specified at gauge 25 by the position of throttle valve 29. Electrical fields created between the first electrode means 3 and the second counterelectrode means 7 cause the gas to be decomposed by glow discharge whereby silicon based materials are deposited on the surface of the cylindrical means 5 contained on the first electrode means 3. Spatially inhomogeneous structures are formed by the sequential introduction and decomposition of appropriate gas mixtures as indicated herein and especially in the copending applications, such as U.S. Pat. No. 4,613,556.

Passivating and protecting overlayers for the imaging members of the present invention can be fabricated from a variety of materials, such as silicon nitride layers plasma deposited from, for example, silane and ammonia mixtures, and silicon carbide layers plasma deposited from, for example, silane and hydrocarbon mixtures. These layers are formed in a thickness of from about 0.1 to about 1.0 micron using essentially the same plasma deposition process as described before.

The silicon based photoreceptor members of the following examples can be tested in a standard scanner, reference specifically Example II, for the purpose of determining the photoconductive characteristics thereof. The scanner is an apparatus in which there is provision for mounting and rotating the layered imaging member product along its axis. Charging corotron exposure, erase lamps, and voltage measuring probes are mounted along the circumference of the member. Testing can be affected by permitting the scanner to operate at a surface speed of 20 revolutions per minute, and subsequently subjecting the imaging member to a positive polarity of 7,000 volts corona potential with a 10 centimeter long corotron. Thereafter, the dark decay and the light induced decay of the potentials can be measured by a series of electrical probes mounted along the circumference of the photoreceptor. The scanner results indicate the charging capabilities of the imaging member, that is the dark decay values, and the discharge characteristics of the photoreceptor when subjected to light illumination.

The invention will now be described in detail with respect to specific preferred embodiments thereof, if being understood that these examples are intended to be illustrative only. The invention is not intended to be limited to the materials, conditions, or process parameters, recited herein. All parts and percentages are by weight unless otherwise indicated.

EXAMPLE I

Silicon oxide powder, 600 grams, with an average particle size diameter of 1.8 micron is mixed with a crystalline silicon power, 20 grams, with a grain size of 2.7 microns at a 30:1 ratio by weight. A slurry is fabricated by progressively adding methylene chloride to the powders until a consistency is obtained, which by blade coating techniques can be distributed over a stainless steel cylindrical substrate of 16 inches in length and with an outside diameter of 9 inches. The cylinder with the coating on it is vacuum dried and vacuum annealed at 750° C. for 60 minutes, which causes the powders to sinter and form a film on the substrate of 7 microns thickness with a density of 2.2 grams/cm$^3$ enabling an imaging member wherein the photogenerating component is hydrogenated amorphous silicon with about 25 percent of atomic hydrogen, and the charge transport component is plasma deposited silicon oxide with 75 atomic percent of oxygen. After cooling, the imaging member device is incorporated in an electrical scanner and subjected to alternating corotron charge and photodischarge cycles at a wavelength of 8,2000 Angstroms. It is believed that the device will accept charge up to a surface potential of 1,500 volts and will discharge to 225 volts, and that these voltages remain constant within 10 percent when the charge-discharge cycling is continued for up to 10,000 cycles. the dark discharge of the device is typically within 100 volts of the charging voltage at electrical fields of 30 volts/$\mu$m, and the electrical performance is insensitive to the humidity content of the ambient air within the limits of 20 to 80 percent relatively humidity at 25° C..

EXAMPLE II

Silicon oxide powder, 600 grams, with an average particle size of 1.8 micron is mixed with 30 grams of crystalline silicon powder with a grain size of 2.7 microns. A slurry is fabricated by progressively adding methylene chloride to the powders until a consistency is obtained which by blade coating techniques can be distributed over a stainless steel cylindrical substrate of 16 inches in length and with an outside diameter of 9 inches. The cylinder with the coating on it is vacuum dried and vacuum annealed at 750° C. for 60 minutes, which causes the powders to sinter and form a photogenerating charge transport film containing silicon oxide with 55 atomic percent of oxygen on the substrate of 70 microns thickness with a density of 2.2 grams/cm$^3$. After cooling, the resulting imaging member device is incorporated in a model 5700$^R$ printer, commercially available from Xerox Corporation. Ten thousand developed images of electronically generated test patterns were obtained and these prints will be of excellent quality with no background deposits and no degradation in the image quality.

EXAMPLE III

In a cylindrical plasma deposition reactor as described in U.S. Pat. No. 4,466,380, the disclosure of which is totally incorporated herein by reference, silane gas and nitrous oxide gas are simultaneously introduced at flow rates of 60 and 180 sccm, respectively, and a total pressure of 300 mTorr. The temperature of the cylindrical drum substrate is maintained at 200° C. and radio frequent power is applied to the substrate. The frequency is 13.56 MHz and the total power is 100 watts. After five minutes the flow of nitrous oxide is stopped and the flow of silane gas is increased to 200 sccm at the same electrical power and substrate temperature and pressure. The silane discharge is maintained for 7 minutes. Subsequently, nitrous oxide is again admitted to the reactor under the conditions described previously and this cycle is repeated 60 times. After the completion of the deposition cycles, the resulting imaging device is cooled and removed from the deposition chamber. Microscopic examination of the resulting film will reveal alternating layers of material consisting of a silicon-oxygen alloy with a silicon to oxygen ratio of about 1:1.7, and hydrogenated amorphous silicon photogenerating regions with 20 atomic percent of hydrogen. Thereafter, the aforementioned imaging member with an aluminum substrate is incorporated in an electrostatic imaging apparatus commercially available from Xerox Corporation as the 3100©. Developed copies of an original document can be obtained and these images will be of excellent and constant quality with no background deposits.

With respect to the aforementioed imaging member, the photogenerating layers, which are of a thickness of 200 Angstroms, are comprised of hydrogenated amorphous silicon with 20 atomic percent by weight of hydrogen, which layers or regions are separated by silicon oxide film with 55 atomic percent by weight of oxygen, which films are of a thickness of 0.5 micron.

EXAMPLE IV

In a cylindrical plasma deposition reactor as described in U.S. Pat. No. 4,466,380, silane gas and nitrous oxide gas are simultaneously introduced at flow rates of 50 and 150 sccm, respectively, and a total pressure of 300 mTorr. The temperature of the cylindrical drum substrate is maintained at 230° C., and radio frequent power is applied to the drum substrate. The frequency is 13.56 MHz and the total power is 100 watts. After five minutes the flow of nitrous oxide is stopped and flow of silane gas is increased to 200 sccm at the same electrical power and substrate temperature and pressure. The silane discharge is maintained for 5 minutes. Subsequently, nitrous oxide is again admitted to the reactor under the conditions described previously and this cycle is repeated 60 times. Finally, silane and ethylene gas are simultaneously introduced to the vacuum system at flow rates of 50 and 350 sccm, respectively, and a total pressure of 500 mTorr. The temperature of the cylindrical drum substrate is maintained at 230° C., and radio frequent power is applied to the drum substrate at 150 watts. After the completion of the deposition cycles, the device is cooled and removed from the deposition chamber. Microscopic examination of the film reveals alternating layers of material consisting of a silicon-oxygen alloy and amorphous silicon with about 20 percent hydrogen. The top surface layer of the device is a 3,000 Angstroms thick silicon-carbon-hydrogen alloy film with approximately equal amounts of carbon and silicon and 15 atomic percent of hydrogen. This layer is transparent to visible light. The resulting imaging device can be incorporated in a xerographic imaging apparatus commercially available from Xerox Corporation as the 3100®. Ten thousand developed images of an original document can be obtained and which images contain no background deposits.

Although the invention has been described with reference to specific preferred embodiments, it is not intended to be limited thereto; rather, those skilled in the art will recognize variations and modifications may be made therein which are within the spirit of the invention will within the scope of the following claims.

What is claimed is:

1. An electrographic imaging member consisting essentially of a supporting substrate; and in contact therewith a photogenerating transport layer comprised of regions of a photogenerating substance dispersed in a matrix of a charge transporting material comprised of plasma deposited silicon oxide with at least 50 atomic percent of oxygen.

2. An imaging member in accordance with claim 1 further including thereover a protective top overcoating layer.

3. An imaging member in accordance with claim 2 wherein the protective top overcoating layer is selected from the group consistig of silicon nitrides, silicon oxides, silicon carbides and amorphous carbon.

4. An imaging member in accordance with claim 1 wherein the photogenerating substance is comprised of hydrogenated amorphous silicon.

5. An imaging member in accordance with claim 1 wherein the photogenerating substance is comprised of halogenated amorphous siicon.

6. An imaging member in accordance with claim 1 wherein the photogenerator substance is comprised of an amorphous silicongermanium alloy.

7. An imaging member in accordance with claim 1 wherein the supporting substrate is rigid or flexible.

8. An imaging member in accordance with claim 1 wherein the supporting substrate is selected from the group consisting of aluminum, chromium, nickel, brass and stainless steel.

9. An imaging member in accordance with claim 1 wherein the supporting substrate is comprised of an insulating material.

10. An imaging member in accordance with claim 9 wherein the insulating material is an organic polymer.

11. An imaging member in accordance with claim 1 wherein the photogenerating substance is dispersed in the charge transport material in an amount of from about 2 percent by weight to about 50 percent by weight.

12. An imaging member in accordance with claim 4 wherein the hydrogenated amorphous silicon contains from about 10 to about 40 atomic percent of hydrogen.

13. An imaging member in accordance with claim 5 wherein the halogenated amorphous silicon contains from about 10 to about 40 atomic percent of halogen.

14. An electrophotographic imaging member consisting essentially of a supporting substrate; and in contact therewith a photogenerating charging transport layer comprised of alternating photogenerating regions situated between charge transporting regions, and wherein the charge transporting regions are comprised of plasma deposited silicon oxides with at least 50 atomic percent of oxygen, wherein there are present at least 5 alternating photogenerating regions.

15. An imaging member in accordance with claim 14 wherein the photogenerating charge transport layer is from about 5 to about 100 microns in thickness.

16. An imaging member in accordance with claim 14 wherein photogenerating regions are comprised of hydrogenated amorphous silicon with from about 10 to about 40 atomic percent of hydrogen.

17. An imaging member in accordance with claim 14 wherein the charge transport regions are comprised of plasma deposited silicon oxide with from about 50 to about 75 atomic percent of oxygen.

18. An imaging member in accordance with claim 14 wherein the supporting substrate is rigid or flexible.

19. An imaging member in accordance with claim 14 wherein the supporting substrate is selected from the group consisting of aluminum, chromium, nickel, brass and stainless steel.

20. An imaging member in accordance with claim 14 wherein the supporting substrate is comprised of an organic polymeric material.

21. A method of imaging which comprises providing the photoresponsive imaging member of claim 1, subjecting this member to imagewise exposure, developing the resulting image with a toner composition, subsequently transferring the developed image to a suitable substrate, and optionally permanently affixing the image thereto.

22. A method of imaging in accordance with claim 21 wherein the charge transport regions are comprised of a plasma deposited silicon oxide of a thickness of from about 5 to about 100 microns.

23. A method of imaging in accordance with claim 21 wherein the photogenerating substance is comprised of hydrogenated amorphous silicon.

24. A method of imaging in accordance with claim 21 wherein the photogenerating substance is comprised of halogenated amorphous silicon.

25. A method of imaging in accordance with claim 21 wherein the photogenerating substance is comprised of a hydrogenated amorphous silicon-germanium alloy.

26. A method of imaging in accordance with claim 21 wherein fixing is accomplished by heating.

27. A method of imaging in accordance with claim 21 wherein the photogenerating substance is comprised of crystalline silicon.

28. A method of imaging in accordance with claim 21 wherein the photogenerating layer is comprised of crystalline silicon.

29. A method of imaging which comprises providing the photoresponsive imaging member of claim 14, subjecting this member to imagewise exposure, developing the resulting image with a toner composition, subsequently transferring the developed image to a suitable substrate, and optionally permanently affixing the image thereto.

30. An imaging member in accordance with claim 13 wherein the alternating photogenerating regions are from about 0.5 to about 1.0 micron in thickness, and the charge transporting regions are from about 0.01 to about 0.3 micron in thickness.

31. A method of imaging in accordance with claim 29 wherein the alternating photogenerating regions of the imaging member are from about 0.5 to about 1.0 micron in thickness, and the charge transporting regions are from about 0.01 to about 0.3 micron in thickness.

* * * * *